US009142149B2

(12) United States Patent
Augustine

(10) Patent No.: US 9,142,149 B2
(45) Date of Patent: Sep. 22, 2015

(54) IMAGE DISPLAY DEVICE

(71) Applicant: Tom Augustine, Powell, OH (US)

(72) Inventor: Tom Augustine, Powell, OH (US)

(73) Assignee: STWRAP, LLC, Powell, OH (US)

( * ) Notice: Subject to any disclaimer, the term of this patent is extended or adjusted under 35 U.S.C. 154(b) by 0 days.

(21) Appl. No.: 14/519,514

(22) Filed: Oct. 21, 2014

(65) Prior Publication Data

US 2015/0089853 A1 Apr. 2, 2015

Related U.S. Application Data

(63) Continuation of application No. 13/761,887, filed on Feb. 7, 2013, now Pat. No. 8,898,943.

(60) Provisional application No. 61/596,939, filed on Feb. 9, 2012, provisional application No. 61/677,237, filed on Jul. 30, 2012.

(51) Int. Cl.

| | |
|---|---|
| ***A44C 5/00*** | (2006.01) |
| ***G09F 3/04*** | (2006.01) |
| ***G09F 3/10*** | (2006.01) |
| ***G09F 3/14*** | (2006.01) |
| ***G09F 3/16*** | (2006.01) |

(52) U.S. Cl.

CPC .. *G09F 3/04* (2013.01); *G09F 3/10* (2013.01); *G09F 3/14* (2013.01); *G09F 3/16* (2013.01)

(58) Field of Classification Search

CPC ..... A01K 11/00; A44C 5/00; G09F 3/14; G09F 3/005; G09F 7/18

See application file for complete search history.

(56) References Cited

U.S. PATENT DOCUMENTS

| | | | | |
|---|---|---|---|---|
| 5,758,443 | A * | 6/1998 | Pedrazzini | 40/633 |
| 8,336,239 | B2 * | 12/2012 | McDermott et al. | 40/633 |
| 8,898,943 | B2 * | 12/2014 | Augustine | 40/607.14 |
| 2005/0235539 | A1 * | 10/2005 | Story | 40/633 |
| 2006/0230661 | A1 * | 10/2006 | Bekker | 40/633 |
| 2012/0080470 | A1 | 4/2012 | Locke | |
| 2012/0080471 | A1 | 4/2012 | Locke | |
| 2012/0080472 | A1 | 4/2012 | Locke | |

* cited by examiner

*Primary Examiner* — Shin Kim

(74) *Attorney, Agent, or Firm* — Kegler Brown Hill & Ritter; James J. Pingor

(57) ABSTRACT

An attachable display device that promotes brand awareness is provided. The device includes a display part having a display area to display an image and a securing portion and a mounting part having an upper portion disposed and secured inside the display part and a lower portion having at least one hole defined therein. The mounting part wraps around an object such that the securing portion engages the at least one hole to secure the display device to the object.

14 Claims, 18 Drawing Sheets

IMAGE DISPLAY DEVICE

CROSS-REFERENCE TO RELATED APPLICATIONS

This application is a continuation of U.S. patent application Ser. No. 13/761,887 filed on Feb. 7, 2013 which claims the benefit of U.S. Provisional Patent Application Ser. No. 61/596,939 entitled "IMAGE DISPLAY DEVICE" filed on Feb. 9, 2012 and to U.S. Provisional Patent Application Ser. No. 61/677,237 entitled "IMAGE DISPLAY DEVICE" filed on Jul. 30, 2012. The entireties of the above-noted applications are herein incorporated by reference.

ORIGIN

The innovation disclosed herein relates to a display device and more specifically to an attachable display device that promotes brand awareness and allegiance.

BACKGROUND

More and more people (adults and children) wear awareness bracelets (wristbands), necklaces, etc. These awareness items can display one's allegiance to a company, a cause, a charity, a business, a sports team, an individual, a character, a movie, a product or service, a destination, etc. Essentially, the awareness item can display an allegiance to just about anything.

Specifically, awareness items can promote brand awareness for businesses, which can result in higher sales of not only one product, but on other products associated with that brand. A brand can take many forms, including a name, product/service, logo, symbol, slogan, color, etc.

Awareness items can also promote awareness to a cause typically referred to as a concept brand. One of the most notable concept brands is breast cancer awareness, which uses a pink ribbon as a symbol to raise awareness of breast cancer and educate people about its symptoms and treatment options.

SUMMARY

The following presents a simplified summary in order to provide a basic understanding of some aspects of the innovation. This summary is not an extensive overview of the innovation. It is not intended to identify key/critical elements or to delineate the scope of the innovation. Its sole purpose is to present some concepts of the innovation in a simplified form as a prelude to the more detailed description that is presented later.

In one aspect of the innovation, an attachable display device that promotes brand awareness is provided. The device includes a display part having a display area to display an image and a securing portion, and a mounting part having an upper portion operatively connected to the display part and a lower portion having at least one hole defined therein. In one aspect, the mounting part wraps around an object such that the securing portion engages the at least one hole to secure the display device to the object. As disclosed herein, the innovation facilitates presentation of allegiance on a strap, backpack, laptop/tablet bag, duffle bag, gym bag, sport equipment bag, golf bag, purse, beach bags etc. This allegiance is to be understood as a feature and benefit of the innovation described herein.

In another aspect of the innovation an image display device is provided and includes a display area to display an image, a removable-transparent cover to facilitate the replacement of the image, a securing portion operatively connected to the display area; and a mounting part operatively connected to the display area and having at least one hole defined therein, wherein the mounting part wraps around an object such that the securing portion engages the at least one hole to secure the image display device to the object.

In another aspect of the innovation, a method of displaying an image is provided and includes providing a display device having a display part and a mounting part, wrapping the mounting part around an object, and engaging a securing portion of the display part with a hole defined in the mounting part.

To accomplish the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
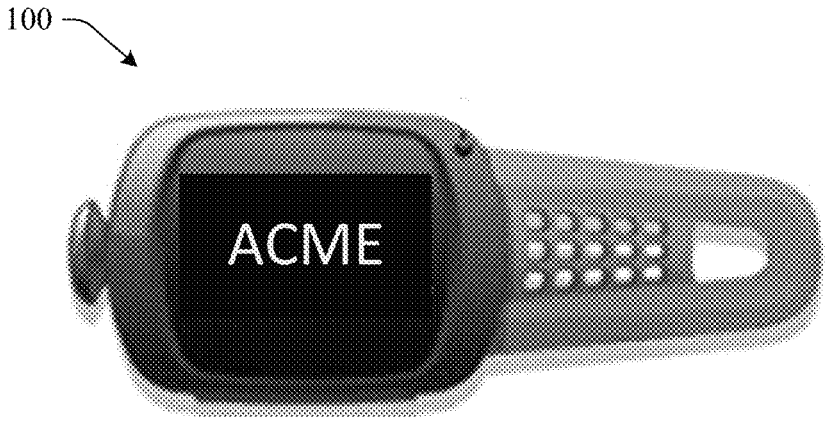
FIGS. 1 and 2 are front and rear view illustrations respectively of example embodiments of a display device displaying an image in accordance with aspects of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details. In other instances, well-known structures and devices are shown in block diagram form in order to facilitate describing the innovation.

While specific characteristics are described herein (e.g., thickness), it is to be understood that the features, functions and benefits of the innovation can employ characteristics that vary from those described herein. These alternatives are to be included within the scope of the innovation and claims appended hereto.

While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

Figure 2:
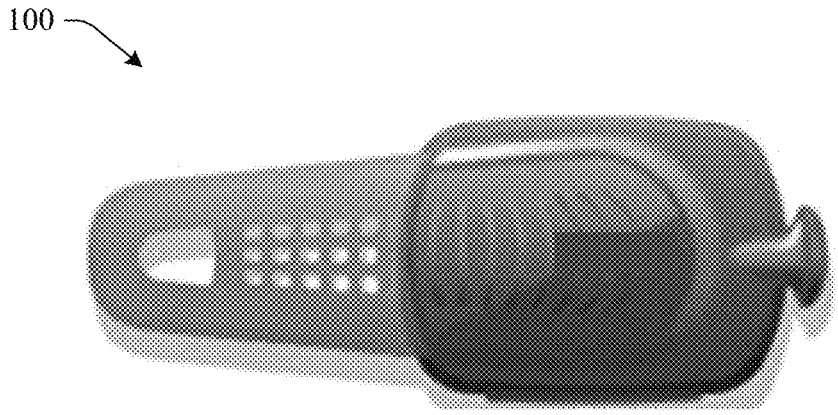

With reference now to the figures, FIGS. 1 and 2 are example embodiments of an attachable device 100 and 200 respectively, details of which will be described further below, that can be used as an awareness item to display an image, such as but not limited to, a brand name, a promotion/campaign, a logo, an individual, mascot, an allegiance, a school name, a team name, a character (e.g., cartoon, television, etc.), an ID or name tag, a locket to hold a picture, a company, a product, a service, a cause, an activity, a destination/stadium, a person, an actor/actress, an artist, an athlete, a singer, a movie/TV show, a slogan, etc. in accordance with aspects of the innovation. For example, as mentioned above, awareness items can be used to promote corporate brand awareness for businesses (see FIG. 1). The brand can take many forms, including a name, sign, symbol, product, service, slogan, color, etc. or a combination thereof. Thus, the innovation provides a means to openly display any type of image, such as a brand image associated with a corporation (e.g., ACME), or a corporation's products, services, campaigns or people. In yet another application, the attachable device can be a collector's item. For example, one could collect a series or a group (e.g., all the teams of a particular sport or the like). Thus, the attachable device can be a collectable and/or used for bargaining for trading.

Still further, the attachable device can be used as a badge to represent an accomplishment. For example, amusement and theme parks may have an attraction badge where once a person attends an attraction (e.g., rides a ride, attends a show, etc.) the person would receive a badge to show that that person conquered that attraction. The badge (attachable device) can be attached to a lanyard or the like so the person can display their accomplishments. In another example the accomplishment may be achieving high grades in school, performing community service, athletic achievements, etc. Thus, it is to be understood that the attachable device has many applications that are not disclosed herein.

FIGS. 3-7 illustrate an example embodiment of an attachable device 300 that can be used as an awareness item that can be attached to a strap on most any object (e.g. briefcase, purse, backpack, tote bag, laptop bag, duffle bag, messenger bag, beach bag, golf bag, lunch bag, equipment bag, camera bag, suitcase, lanyards, etc.) in accordance with aspects of the innovation. The attachable device 300 can also be used as a holder to hold objects, such as but not limited to, pens, pencils, a shirt, head phones, power cords for electronic devices, etc. The attachable device 300 includes a display part 302 and a mounting part 304. The display part 302 receives a portion of the mounting part 304, as illustrated in the figures.

The display part 302 includes a first (front) portion 306 having a display area 308, a second (back) portion 310, a connecting portion 312 pivotally connecting the first portion 306 and the second portion 310, a securing portion (projection) 314, and a latching portion 316. The display area 308 is where the image is displayed, as shown in FIGS. 1 and 2. Although the shape of the display area 308 shown in the figures is rectangular, the shape of the display area 308 may be any shape, such as but not limited to, circular, square, triangular or any polygonal shape.

In one embodiment, display part can be manufactured with the image as part of the display area 308, as shown in FIGS. 1 and 2. In other embodiments, the image can be applied to the display area 308 after manufacture of the display part 302 with an adhesive, a magnet (described further below), or the image can be self-sticking, such as a sticker. In still yet other aspects, a pad print, decal, silk screen, a dome (transparent or non-transparent) with a digital print attached or the like can be employed. The dome can be made from any material, such as but not limited to urethane.

Figure 3:
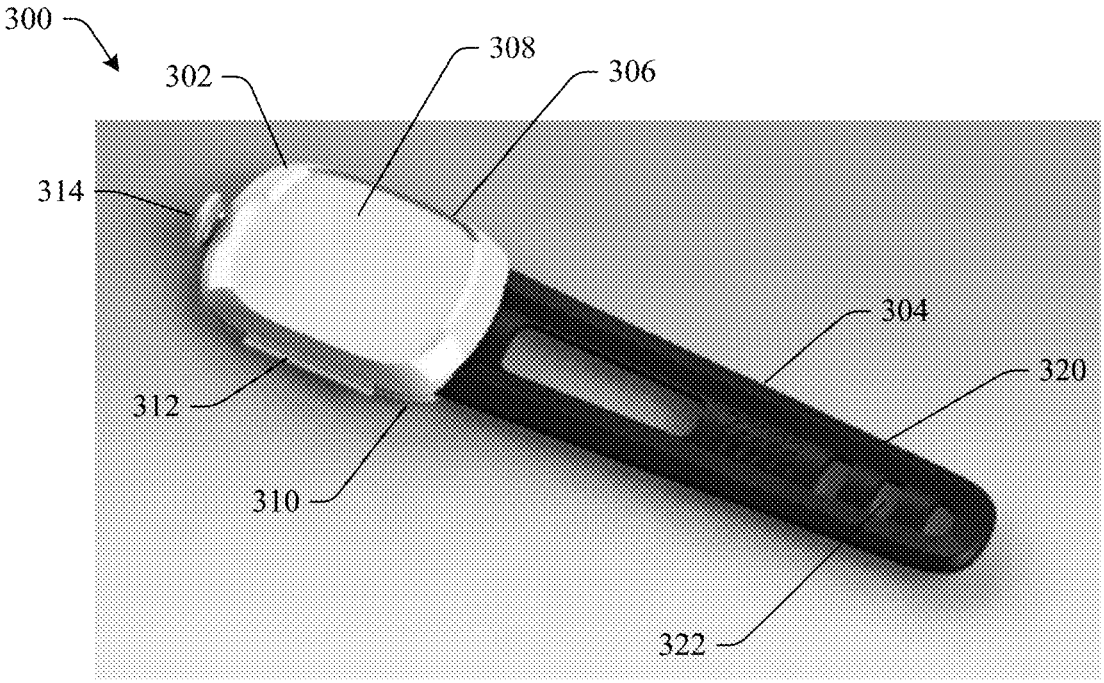
FIG. 3 is a perspective view of an example embodiment of a display device in accordance with aspects of the innovation.
Figure 4:
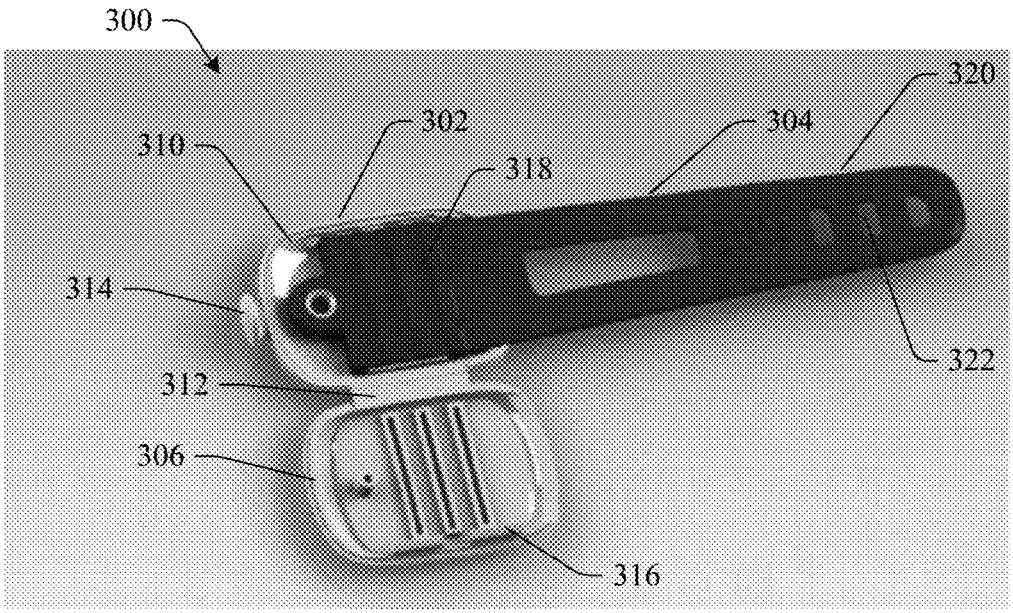
FIG. 4 is a perspective view of the example display device of FIG. 3 with a display part in an open state in accordance with aspects of the innovation.
Figure 5:
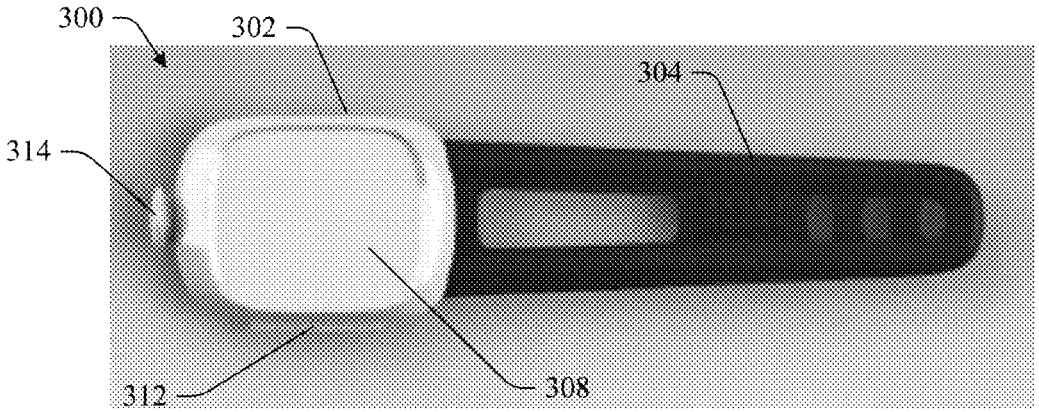
FIG. 5 is a front view of the example display device of FIG. 3 in accordance with aspects of the innovation.
Figure 6:
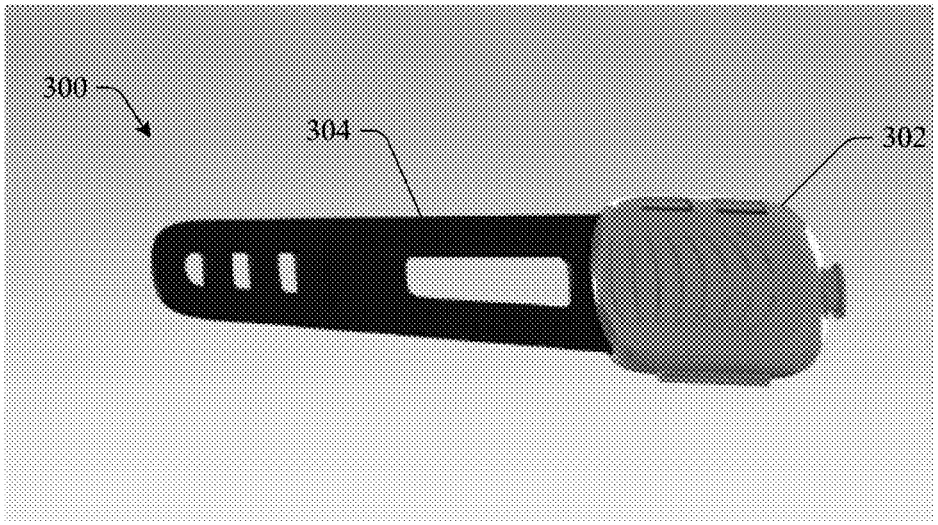
FIG. 6 is a rear perspective view of the example display device of FIG. 3 in accordance with aspects of the innovation.
Figure 7:
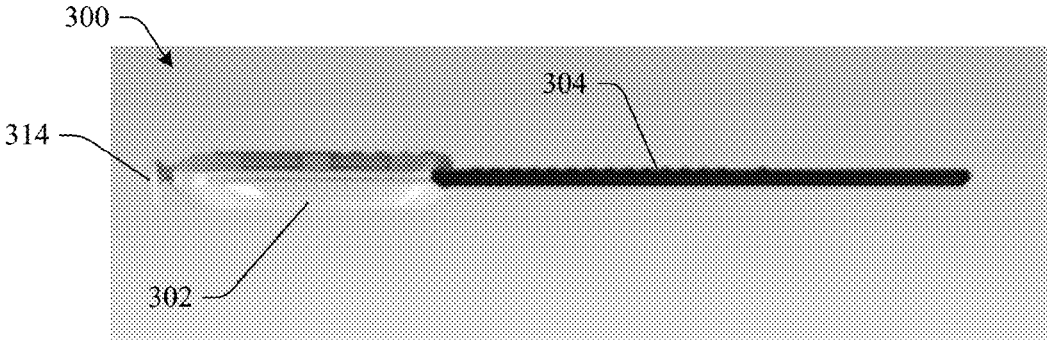
FIG. 7 is a side view of the example display device of FIG. 3 in accordance with aspects of the innovation.
Figure 8:
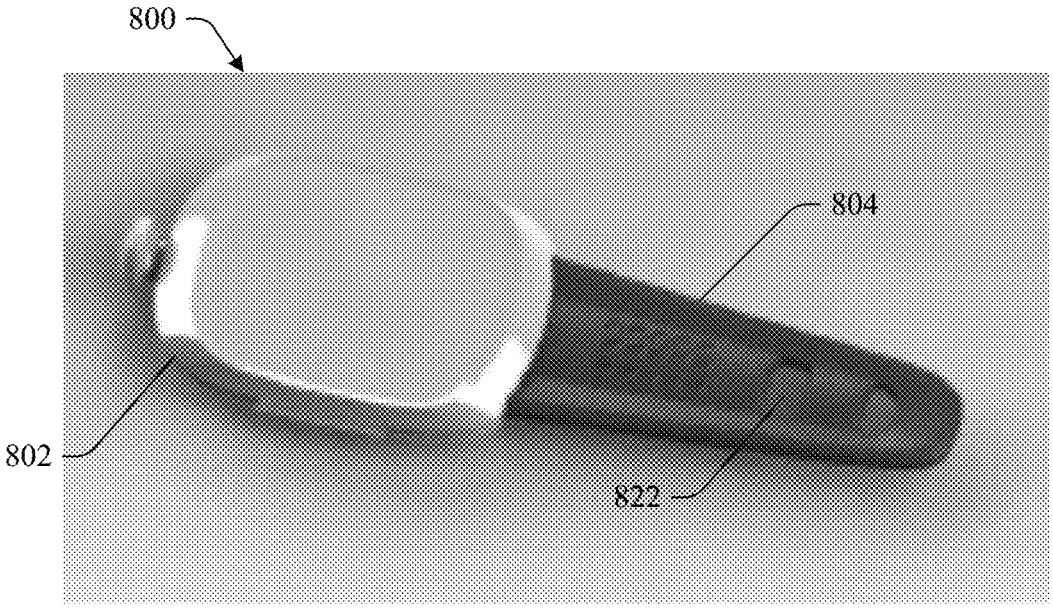
FIG. 8 is a perspective view of another example embodiment of a display device in accordance with aspects of the innovation.
Figure 9:
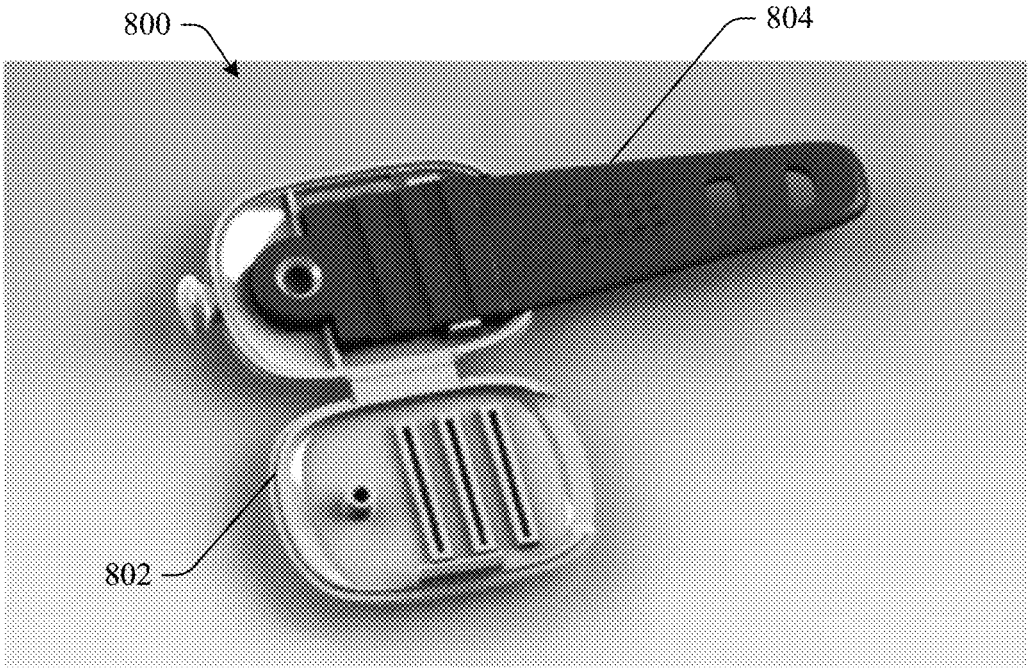
FIG. 9 is a perspective view of the example display device of FIG. 8 with a display part in an open state in accordance with aspects of the innovation.
Figure 10:
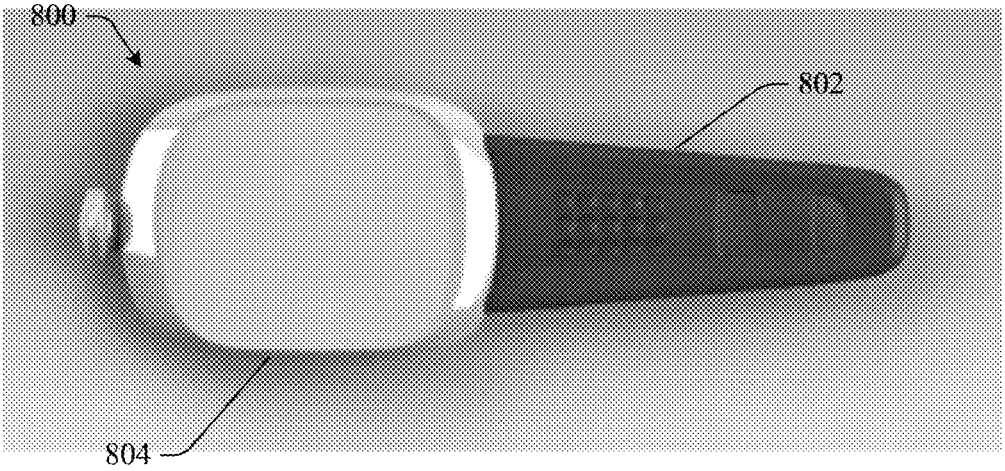
FIG. 10 is a front view of the example display device of FIG. 8 in accordance with aspects of the innovation.
Figure 11:
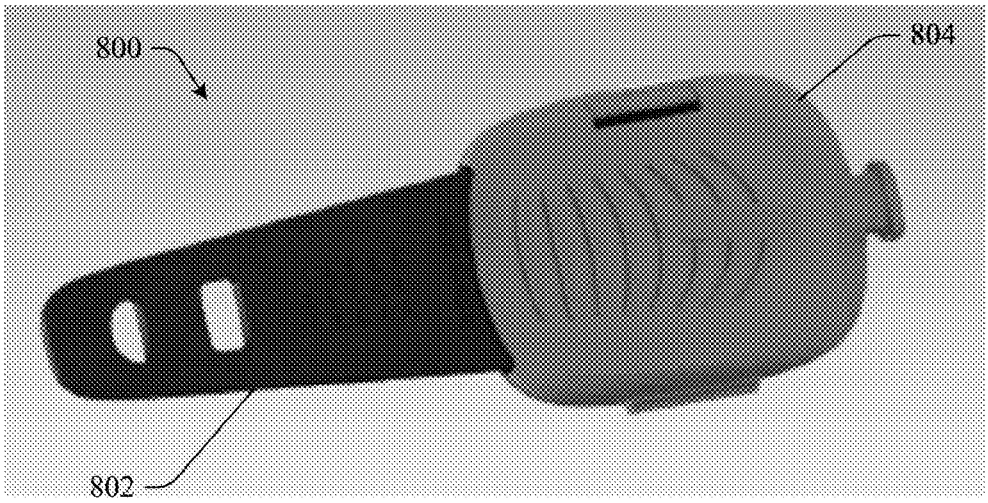
FIG. 11 is a rear perspective view of the example display device of FIG. 8 in accordance with aspects of the innovation.
Figure 12:
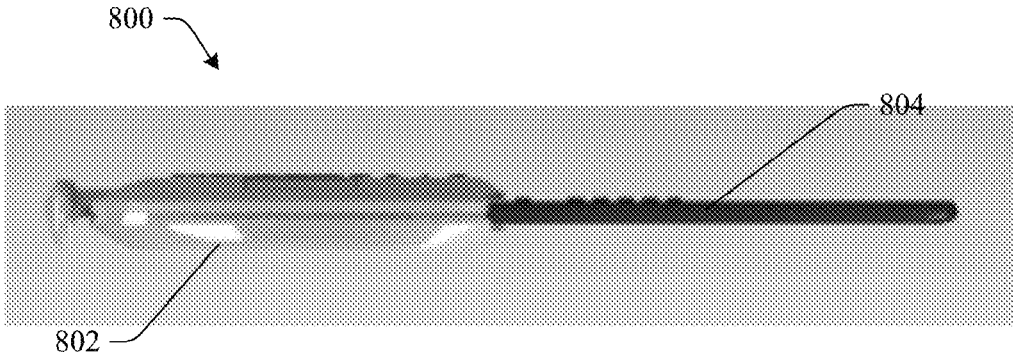
FIG. 12 is a side view of the example display device of FIG. 8 in accordance with aspects of the innovation.
Figure 13A:
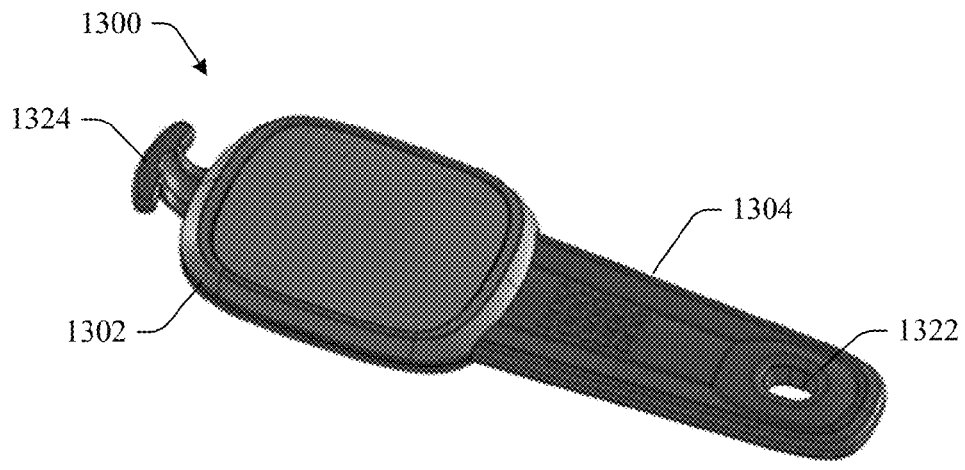
FIGS. 13A-13F are illustrations of another example embodiment of a display device displaying an image in accordance with aspects of the innovation.
Figure 13B:
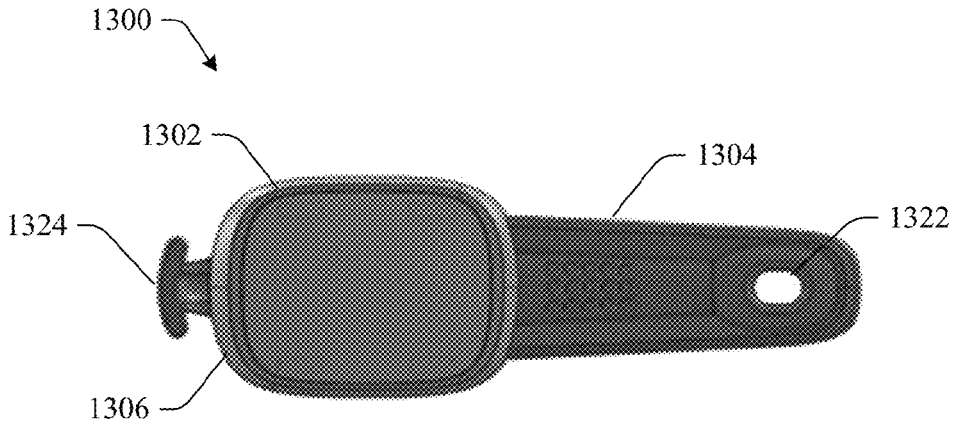
Figure 13C:
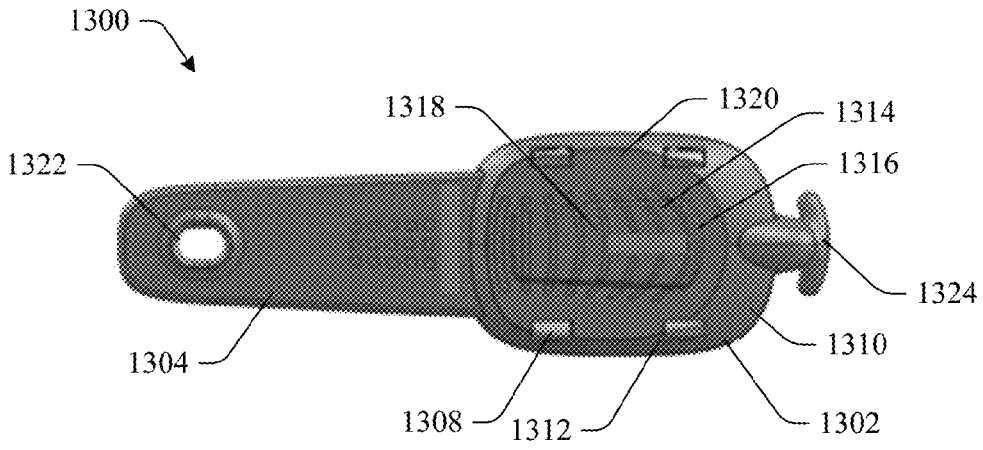
Figure 13D:
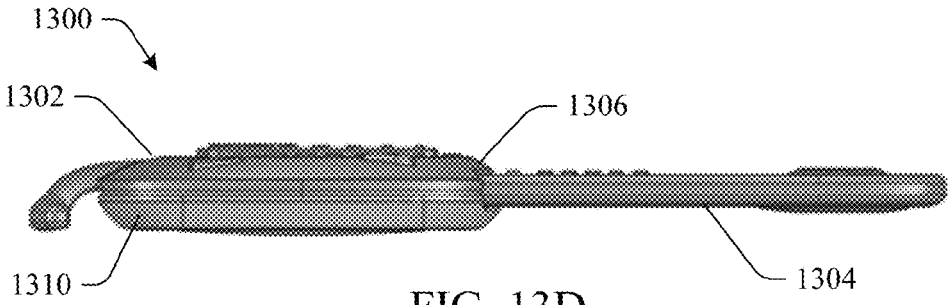
Figure 13E:
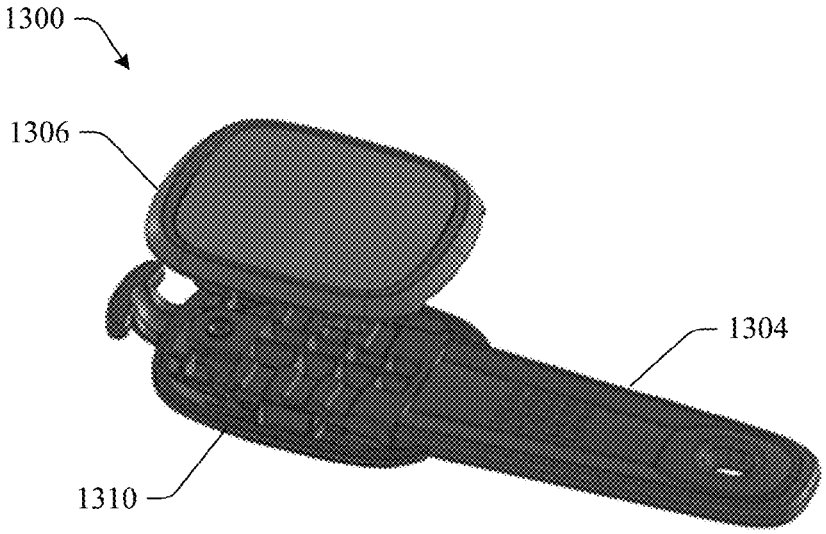
Figure 13F:
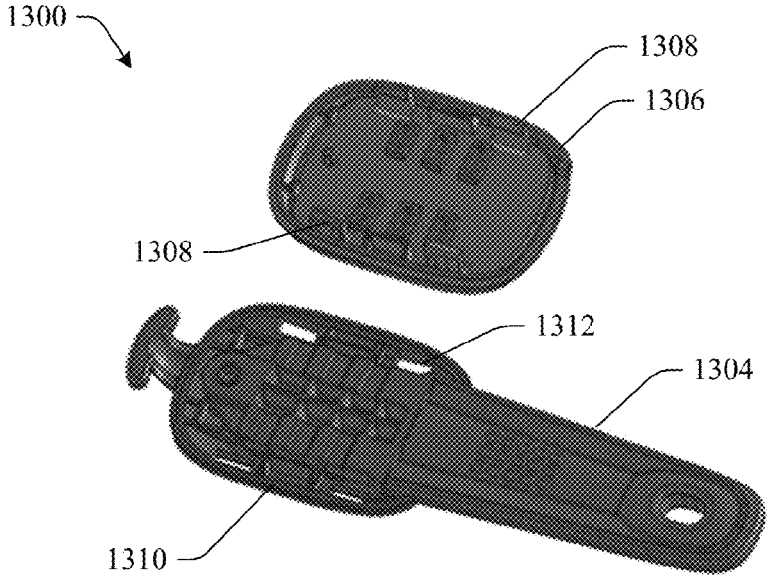

In one example embodiment (shown in FIG. 4), the display part 302 can be an integrated piece made from any suitable material, such as but not limited to, polyethylene, polypropylene, Acrylonitrile Butadiene Styrene (ABS), PA66 Nylon, etc. The connecting portion 312 is an integrated part of the display part 302 and flexes to allow the display part 302 to pivotally open and close. Thus, the connecting portion 312 is made from the same material as the display part 302 and in an example embodiment functions as a living hinge. Thus, the display part 302 can be opened and closed as many times as desired. The latching portion 316 latches the first portion 306 to the second portion 310 when the display part 302 is in the closed state, as shown in FIG. 3. It is to be understood that alternative aspects can employ a snap-together assembly, as described below in reference to FIGS. 13 and 14. Further, a single (e.g., molded) aspect can be employed to facilitate the features, functions and benefits of the innovation. In yet another example, an image (e.g., allegiance artwork or the like) can be displayed upon a single piece (e.g., soft band). These alternative examples are to be included within the scope of the innovation and claims appended hereto.

Still referring to FIGS. 3-7, the mounting part 304, which serves as a strap, can be made from a suitable elastic material, such as but not limited to rubber, plastic, Styrene ethylene butadiene styrene (SEBS), tpe plastic, silicon, leather, etc., that allows the mounting part 304 to stretch when the display device 300 is used as intended. The mounting part 304 is an integrated piece that includes a first (upper) portion 318 disposed and secured inside the display part 302 and a second (lower) portion 320. Multiple holes 322 are defined in the lower portion 320 of the mounting part 304 to attach the lower portion 320 of the mounting part 304 to the securing portion 314 of the display part 302 and for adjustability, as will be described further below. It is to be appreciated that small(er) versions may limit the number of holes. These holes are used to accommodate various sized straps. It is also to be appreciated that other types of fastening devices may be incorporated into the attachable device 300, such as but not limited to, snaps, clips, hook & loop, a buckle, etc. to secure the attachable device to the object.

With reference now to FIGS. 8-12, FIGS. 8-12 illustrate an another example embodiment of an attachable device 800 that can be used as an awareness item that can be strapped to most any object mentioned above, in accordance with aspects of the innovation. The attachable device 800 includes a display part 802 and a mounting part 804.

The attachable device 800 shown in FIGS. 8-12 is similar to the attachable device 300 described above and illustrated in FIGS. 3-7, with the exception of the length of the mounting part 804. Specifically, the length of the mounting part 804 in this embodiment is shorter than a length of the mounting part 304 described above. As such, the number of holes 822 defined in the mounting part 804 is less than the number of holes 322 in the embodiment described above. While a specific embodiment is shown, alternative aspects can include other sizes, shapes, orientations, and configurations as desired or appropriate. For example, item 800 can be a smaller version (e.g., smaller face and strap) that will accommodate straps in the 1" to 1½" range. Additionally, item 300 is a larger product (larger face and strap) that will accommodate larger straps in the 2"-2¾" range (e.g., back pack and messenger straps).

As such, the length of the mounting part 804, 304 can vary depending on the strap size of the object mentioned above the attachable device will be displayed. It is to be appreciated, however, that the innovation described herein is not limited to the length of the mounting part. In other words, the length of the mounting part can be any desired length and can any number of holes to facilitate adjusting the attachable device to adapt to different sized objects or straps. For example, the attachable device can have one hole or multiple holes. Further, the hole(s) can be any shape, such as but not limited to circular, semi-circular, square, elongated, etc. In addition, the material can be elastic and can stretch to accommodate various size straps. All other aspects and functions of this embodiment are similar to the embodiment described above and, thus, will not be repeated.

FIGS. 13A-13F is an illustration of another embodiment of an attachable device 1300 in accordance with an aspect of the innovation. The attachable device 1300 includes a display part 1302 and a mounting part 1304.

The display part 1302 can be an integrated piece made from any suitable material, such as but not limited to, polyethylene, polypropylene, Acrylonitrile Butadiene Styrene (ABS), PA66 Nylon, etc. The display part 1302 is comprised of two separate parts, as opposed to a single part as described above. Specifically, the display part 1302 may include a separate first (or front) portion 1306 having a display area similar to the display area 308 described above and multiple projections (or tabs) 1308 extending from a rear of the first portion 1306, and a separate second (or rear) portion 1310 having multiple small apertures 1312. To assemble, the first portion 1306 is placed on one side of the mounting part 1304 and the second portion 1310 is placed on the other side of the mounting part 1304 such that the projections 1308 align with the small apertures 1312. The first portion 1306 and the second portion 1310 are pressed together to allow the projections 1308 to snap into or engage the apertures 1312.

The mounting part 1304, which serves as a strap, can be made from a suitable elastic material, such as but not limited to rubber, plastic, Styrene ethylene butadiene styrene (SEBS), tpe plastic, silicon, leather, etc., that allows the mounting part 1304 to stretch when the display device 1300 is used as intended. The mounting part 1304 may include an alignment projection 1314 that engages a large aperture 1316 defined in the second portion 1310 to facilitate alignment of the display part 1302 to the mounting part 1304. When assembled, a face 1318 on the alignment projection 1314 may be flush with a face 1320 on the second portion 1310. The alignment projection 1314 further provides friction or traction between the display part 1302 and the mounting part 1304 to secure the display part 1302 to the mounting part 1304.

A hole 1322 is defined in the mounting part 1304, whereby the hole 1322 engages a securing portion (projection) 1324 to facilitate the mounting of the attachable device 1300 to a strap or object mentioned above.

Figure 14A:
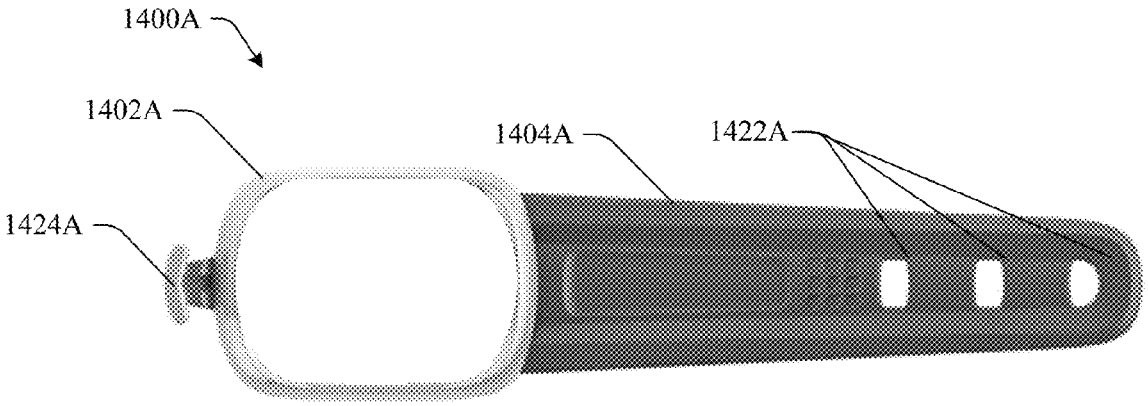
FIGS. 14A-14B are illustrations of other example embodiments of a display device in accordance with aspects of the innovation.

FIG. 14A illustrates another embodiment of an attachable device 1400A in accordance with an aspect of the innovation. The attachable device 1400A illustrated in FIG. 14A is similar to the attachable device 1300 illustrated in FIGS. 13A-13F in that the attachable device 1400A includes a two part display part 1402A and a mounting part 1404A. The mounting part 1404A in this embodiment, however, includes multiple holes 1422A that engage a securing portion (projection) 1424A that facilitates the mounting of the attachable device 1400A to an object mentioned above. The multiple holes 1422A allow the attachable device 1400A to adjust to different sized objects.

Figure 14B:
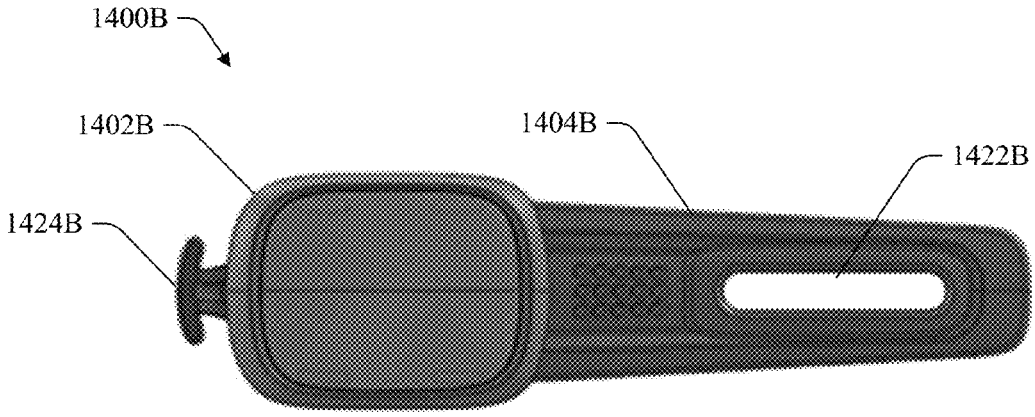

FIG. 14B illustrates another embodiment of an attachable device 1400B in accordance with an aspect of the innovation. The attachable device 1400B illustrated in FIG. 14B is similar to the attachable device 1300 illustrated in FIGS. 13A-13F in that the attachable device 1400B includes a two part display part 1402B and a mounting part 1404B. The mounting part 1404B in this embodiment, however, includes at least one elongated opening 1422B that engages a securing portion (projection) 1424B that facilitates the mounting of the attachable device 1400B to an object mentioned above.

Figure 15A:
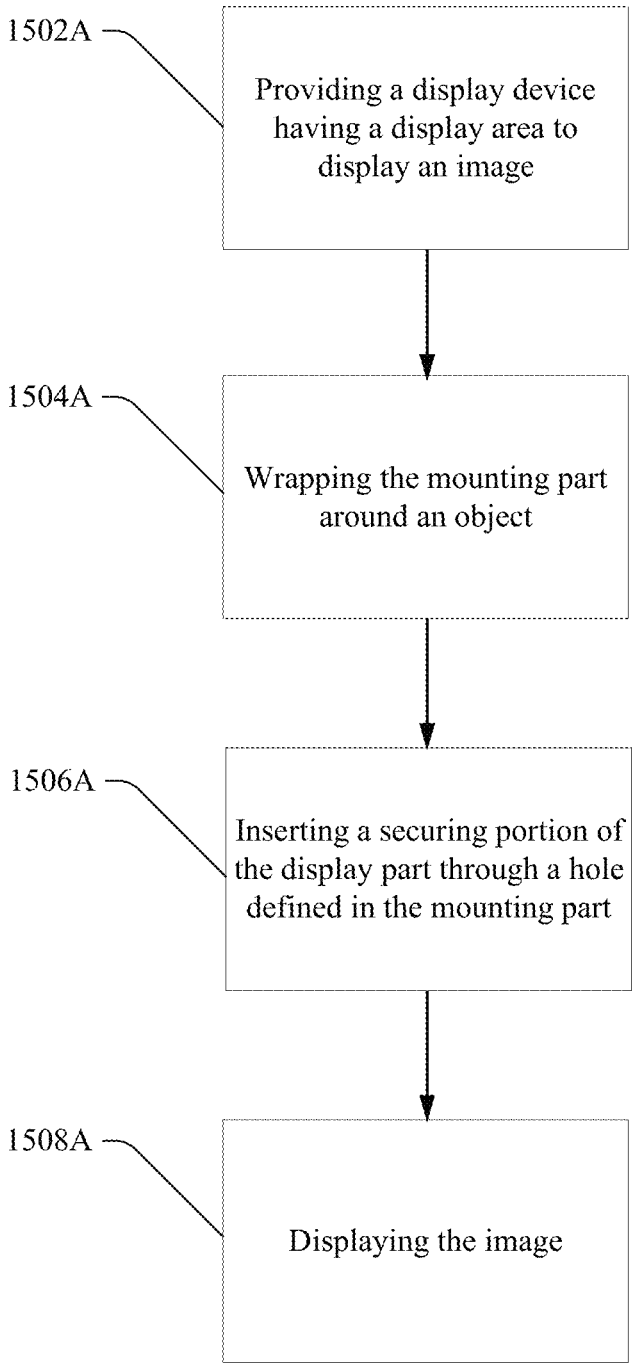
FIG. 15A illustrates a method of displaying an awareness item in accordance with aspects of the innovation.
Figure 15B:
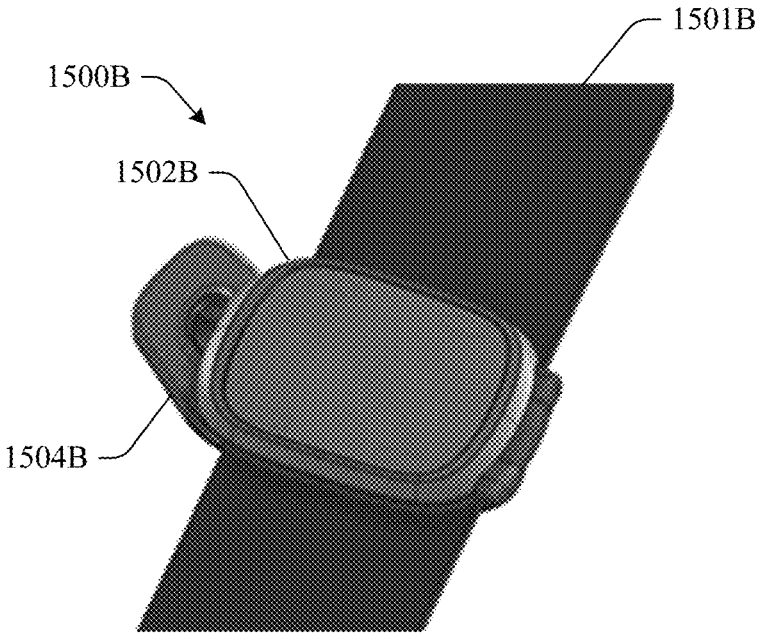
FIGS. 15B and 15C are top and bottom illustrations of the awareness item attached to a strap in accordance with an aspect of the innovation.
Figure 15C:
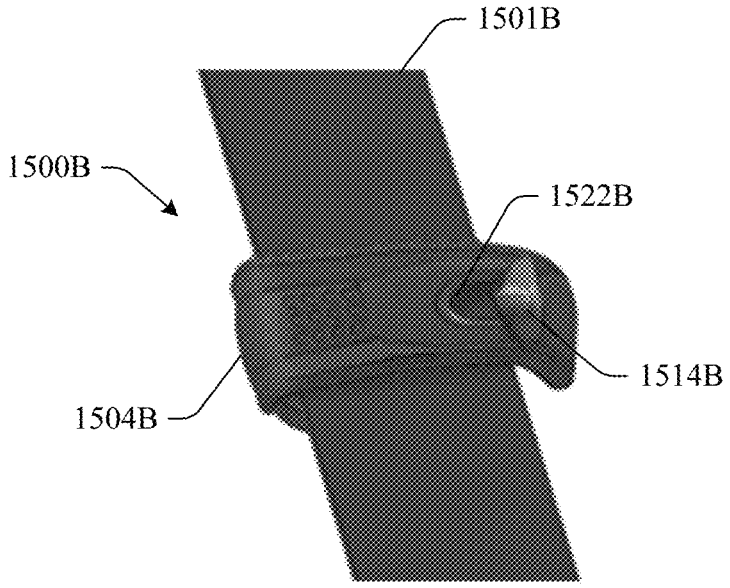
Figure 16:
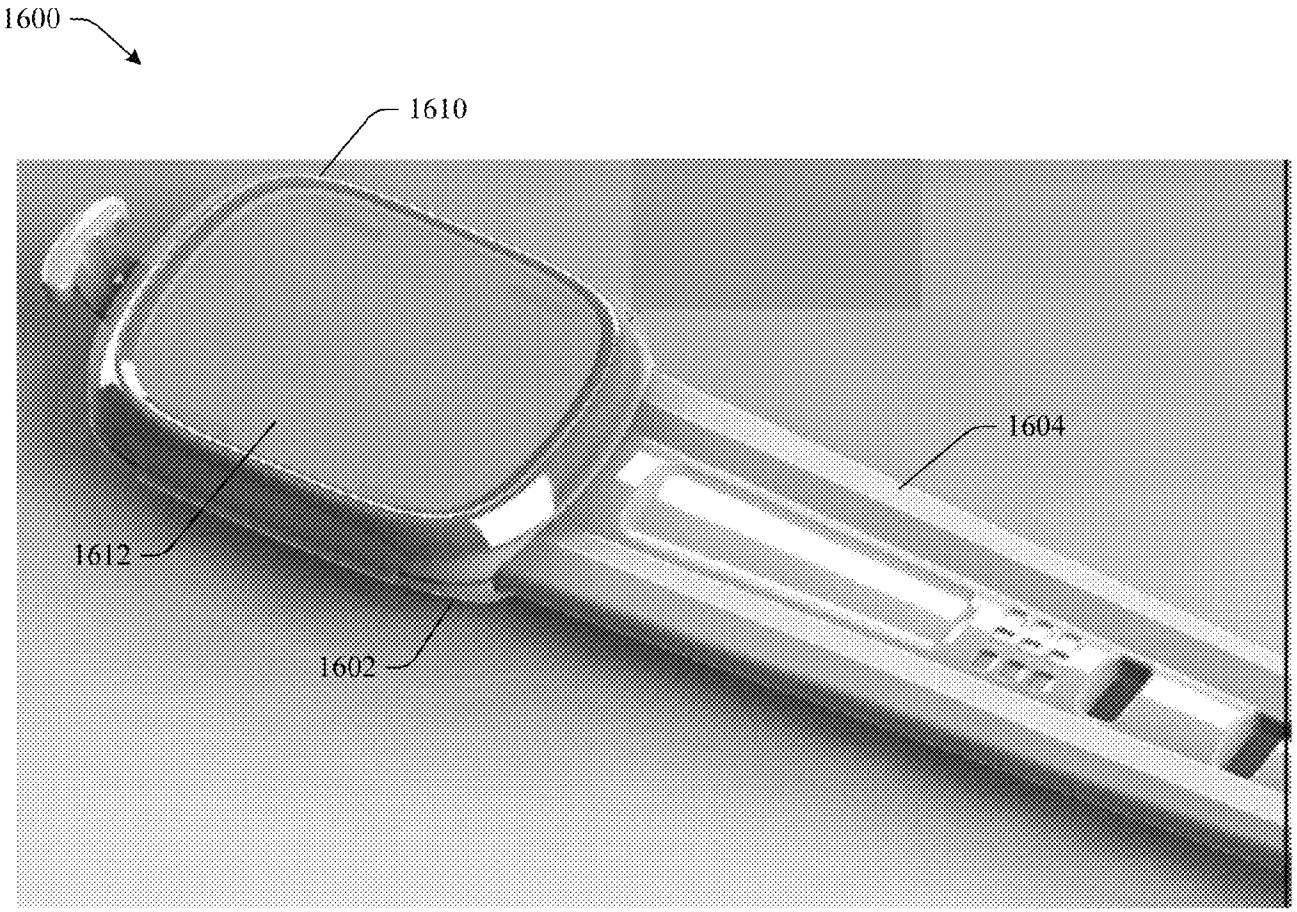
FIG. 16 is a perspective view of an example embodiment of a display device incorporating a removable cover in accordance with an aspect of the innovation.

Referring to FIGS. 15A-15C, a method of displaying an awareness item 1500B on a strap 1501B or object mentioned above is described. At 1502A, the attachable device 1500B, which includes the display part 1502B and the mounting part 1504B, is provided, where the display part 1502B includes the display area to display an image. At 1504A, the user wraps the mounting part 1504B around the strap 1501B such that the display part is on a front of the strap 1501B such that the display area is facing outward to openly display the image. At 1506A, the securing portion 1514B is inserted through one of the holes 1522B defined in the mounting portion 1504B, thereby securing the attachable device 1500B to the strap 1501B. In alternative aspects, item 1514B can be designed more like a hook or the like to hold the strap. At 1508A, the image is displayed.

FIGS. 16-20 illustrate yet another embodiment of the attachable device 1600 in accordance with an aspect of the innovation. The attachable device 1600 is similar to the device described above in that the attachable device 1600 includes a display part 1602 and a mounting part 1604 whereby the display part 1602 receives a portion of the mounting part 1604, thus, like parts will not be repeated.

The attachable device 1600 in this embodiment further includes a cover (dome) 1610 that attaches to the display part 1602. The cover 1610 includes a face 1612 where a user can either place a sticker, decal, etc. on the face 1612 or simply slide an image printed on a piece of paper or similar medium onto the face 1612 to personalize the attachable device 1600. For example, the user can purchase stickers at the same time when purchasing the attachable device 1600 or download and print the stickers. Further, stickers or decals can be created with a custom paper punch where the punch has a similar shape to the display part.

In addition, the face 1612 may be transparent (clear or colored) to allow the user to view the display area of the display part 1602. For example, a user can personalize the device by placing an insert on the display part 1602 and attach the cover 1610 to the display part 1602 whereby the insert can be viewed through the transparent face 1612. For example, a user can insert a picture, emblem, logo, etc. on the display part 1602 to personalize the attachable device 1600. A user can further personalize the attachable device 1600 by having their picture taken with a character from a theme park, an animal at a zoo, or a thrill ride at an amusement park, etc. In addition, the face 1612 may include magnification to magnify the display area of the display part 1602.

Figure 17:
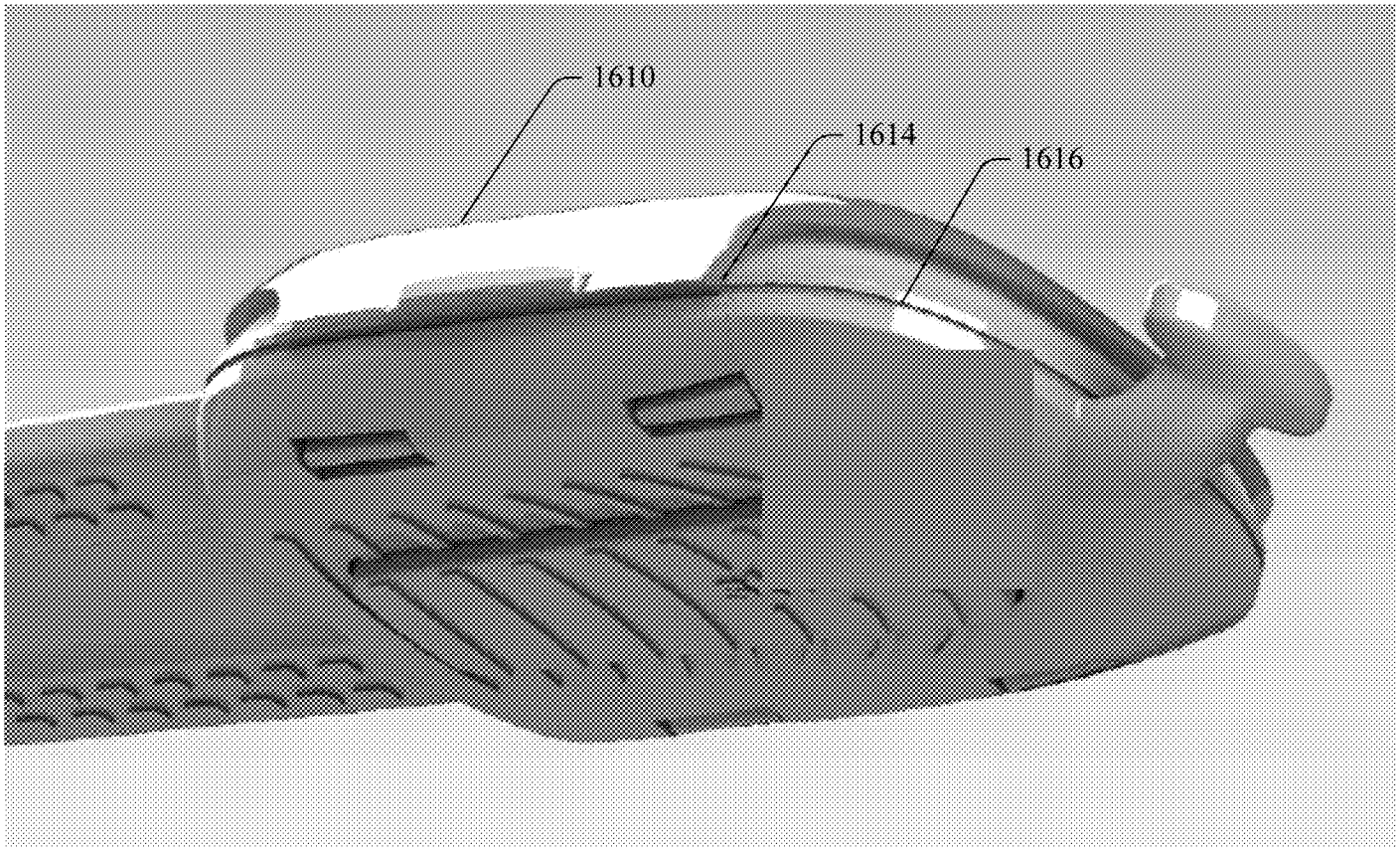
FIG. 17 is a close-up bottom perspective view of the example display device of FIG. 16 incorporating the removable cover in accordance with an aspect of the innovation.
Figure 18:
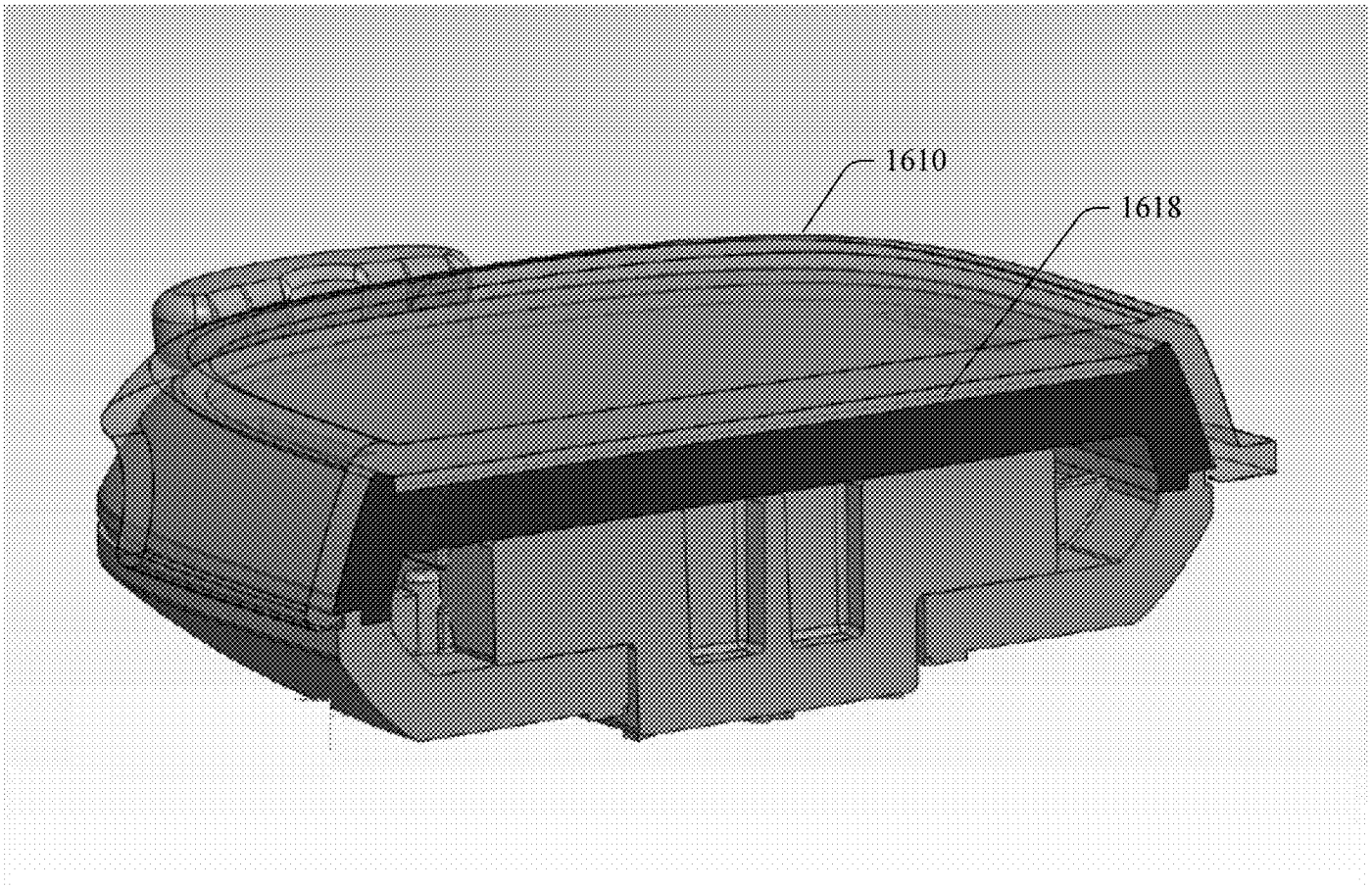
FIG. 18 is a cross-section perspective view of the example display device of FIG. 16 incorporating the removable cover in accordance with an aspect of the innovation.

Referring to FIGS. 17 and 18, the cover 1610 includes an undercut portion 1614 that snaps into a groove 1616 on the display part 1602 to secure the cover 1614 onto the attachable device 1602. A gap 1618, see FIG. 18, facilitates insertion of the insert into the attachable device 1600. In another aspect the gap 1618 may be adapted to receive multiple inserts.

Figure 19:
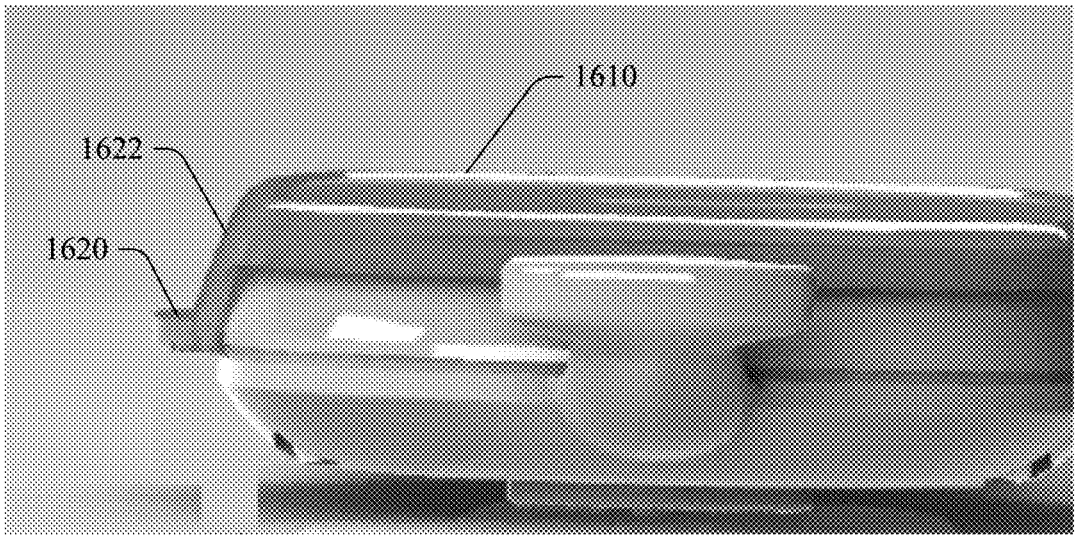
FIG. 19 is a close-up view of the removable cover illustrating a tab in accordance with an aspect of the innovation.

Referring to FIG. 19, the cover 1610 further includes a tab 1620 situated on one or both sides 1622 of the cover 1610. The tab 1620 facilitates attachment and removal of the cover 1610 to and from the attachable device 1600.

Figure 20:
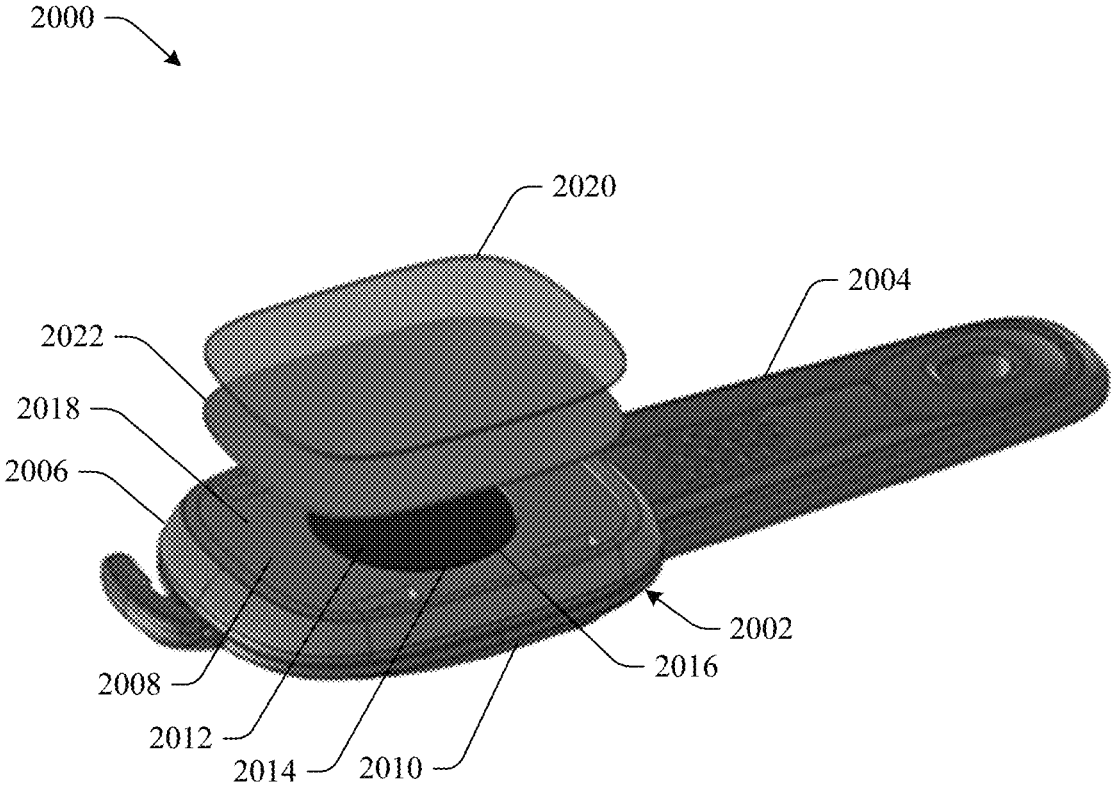
FIG. 20 is an illustration of another example embodiment of a display device incorporating a removable-magnetic cover in accordance with an aspect of the innovation.

FIG. 20 illustrates still yet another embodiment of an attachable device 2000 in accordance with an aspect of the innovation. The embodiment illustrated in FIG. 20 has similar features to the embodiments described above and, thus, a detailed description of the similar features will not be repeated. The attachable device 2000 includes a display part 2002 and a mounting part 2004. The mounting part 2004 is similar to those described above and, thus, the details thereof will not be repeated. The display part 2002 includes a first (front) portion 2006 having a display area 2008, and a second (back) portion 2010. The display part 2002 in this embodiment may be a single piece as illustrated in FIGS. 3-12 or a two piece part as illustrated in FIGS. 13A-13F.

A magnet 2012 is disposed in an opening 2014 defined in the display area 2008 such that a top 2016 of the magnet 2012 is flush with a top surface 2018 of the display area 2008. The attachable device 2000 further includes a removable-transparent cover or dome 2020 made from a material, such as but not limited to a metal, adapted to be magnetically attracted to the magnet 2012.

The above configuration facilitates inserting, removing, replacing, and securing an insert 2022 containing an image to the attachable device 2000. In other words, the insert 2022 is placed on the display area 2008 and the magnetic cover 2020 is then placed on the insert 2022. The magnetic cover 2020 magnetically adheres to the magnet 2012 to thereby secure the insert 2022 to the display part 2002. If the user wishes to replace the insert 2022, the user simply removes the cover 2020 and the insert 2022 and places another insert 2022 containing a different image on the display area 2008. Thus, this configuration facilities the interchangeability of images.

In an alternate embodiment, the insert 2022 may be magnetized or may include a magnet to secure the insert 2022 to the display area 2008. In addition, the cover 2020 can also be magnetized or contain a magnet or can be adapted to snap, slide, etc. into fasteners, such as but not limited, rails, clips, etc. on the display area 2008.

It is to be appreciated, however, other means of removably attaching the cover to the first portion may be provided to facilitate the interchangeability of images. For example, first portion 2006 of the display part 2002 may include clips or rails to allow the cover to slidably attach to the first portion 2006.

Figure 21A:
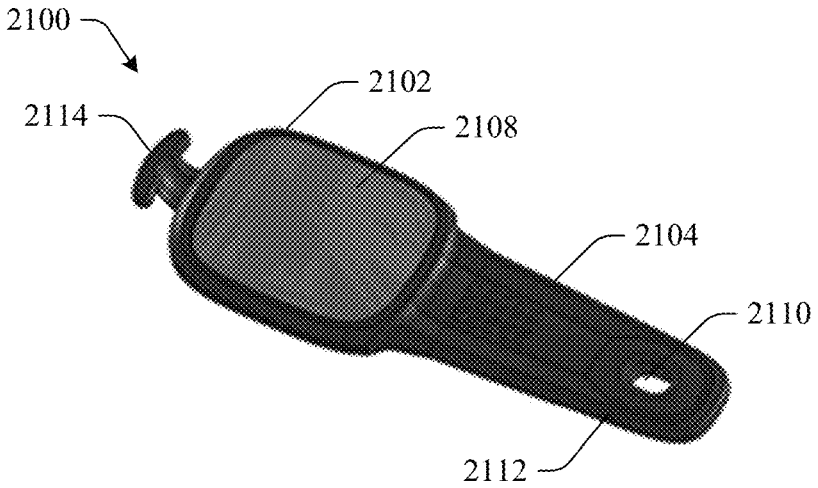
FIGS. 21A-21B are illustrations of another embodiment of a display device in accordance with an aspect of the innovation.
Figure 21B:
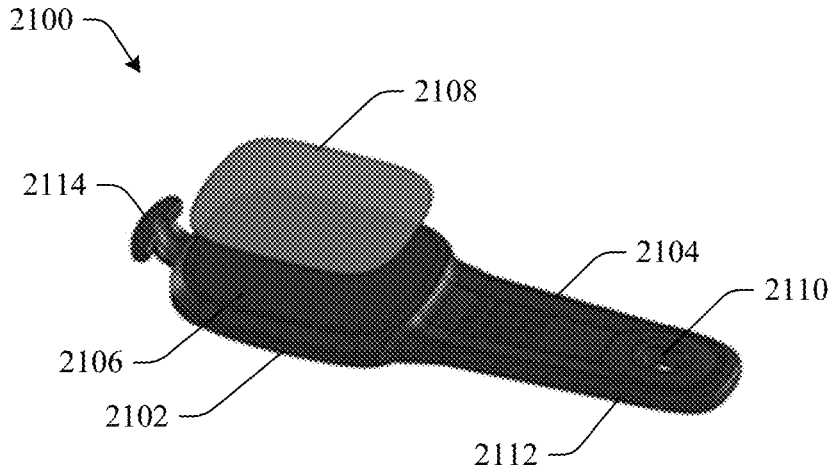

FIGS. 21A-21B illustrate yet another embodiment of an attachable device 2100 in accordance with an aspect of the innovation. The attachable device 2100 in this embodiment combines a display part 2102 and a mounting part 2104 into a single integrated piece. As in the embodiments above, the attachable device 2100 in this embodiment can be made from a suitable elastic material, such as but not limited to rubber, plastic, styrene ethylene butadiene styrene (SEBS), tpe plastic, silicon, leather, etc., that allows the mounting part 304 to stretch when the display device 300 is used as intended.

The display part 2102 includes a display area 2106 for the attachment of an image 2108 as described herein. The image 2108 may be attached to the display area 2106 in any fashion as described herein.

A hole 2110 is defined in a lower portion 2112 of the mounting part 2104. When the attachable device 2100 is displayed on a strap or the like, a securing portion (projection) 2114 that extends from the display part 2102 engages the hole 2110 to facilitate the attachment of the attachable device 2100 to an object as mentioned above.

All other aspects of the embodiment illustrated in FIGS. 21A and 21B are similar to those described above and will not be repeated.

Figure 22A:
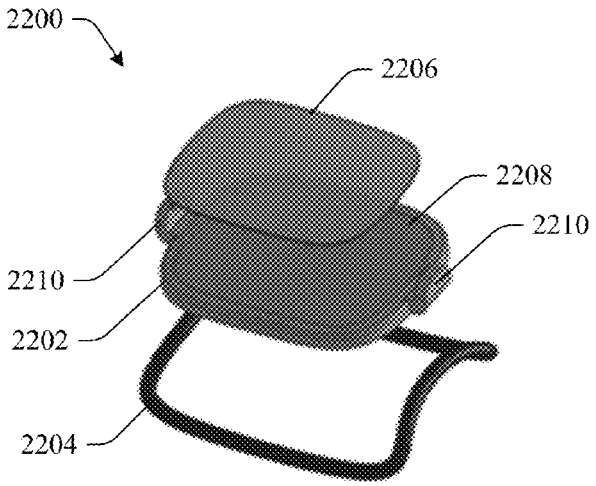
FIGS. 22A-22C are illustrations of another embodiment of a display device in accordance with an aspect of the innovation.
Figure 22B:
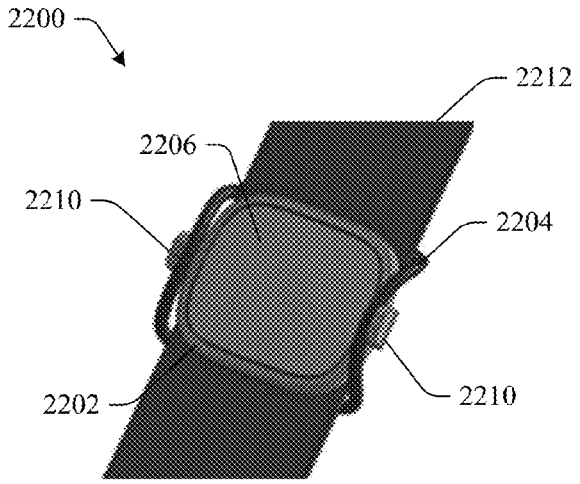
Figure 22C:
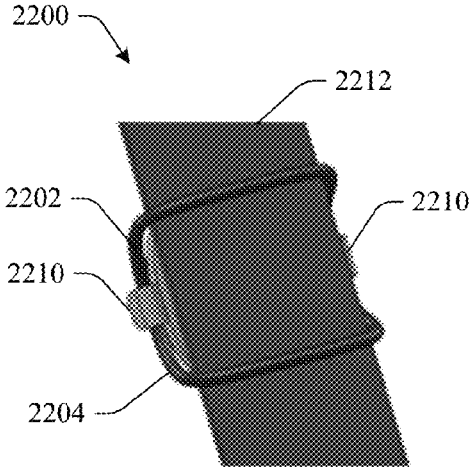

FIGS. 22A-22C illustrate another embodiment of an attachable device 2200 in accordance with an aspect of the innovation. The attachable device 2200 includes a display part 2202, a fastening (mounting) part 2204, and a cover or dome 2206.

The display part 2202 includes a display area 2208 adapted to receive an image by any means as described herein. The display part 2202 is a single integrated piece that further includes ears 2210 for the attachment of the fastening device 2208, described below.

The fastening part 2204 may be made from an elastic material and removably attaches the display part 2202 to an object or a strap 2212 on most any object (e.g. briefcase, purse, backpack, tote bag, laptop bag, duffle bag, messenger bag, beach bag, golf bag, lunch bag, equipment bag, camera bag, suitcase, lanyards, etc.) in accordance with aspects of the innovation. For example, as illustrated in FIGS. 22B-22C, the fastening part 2204 wraps around a back of the strap 2212 and extends around to a front of the strap 2212 and wraps around each ear 2210 on the display part 2202, thereby attaching the display part 2202 to the strap 2212.

The dome 2206 may be made from any transparent material, such as but not limited to, urethane. The dome 2206 attaches to the display part 2202 once the image is in place by any means as described herein. In another embodiment, in lieu of the image being placed directly on the display area 2208, the dome 2206 may include a digital print sticker, decal, etc. In addition, the dome 2206 may be transparent and removable to facilitate the interchangeability of the image.

Figure 23A:
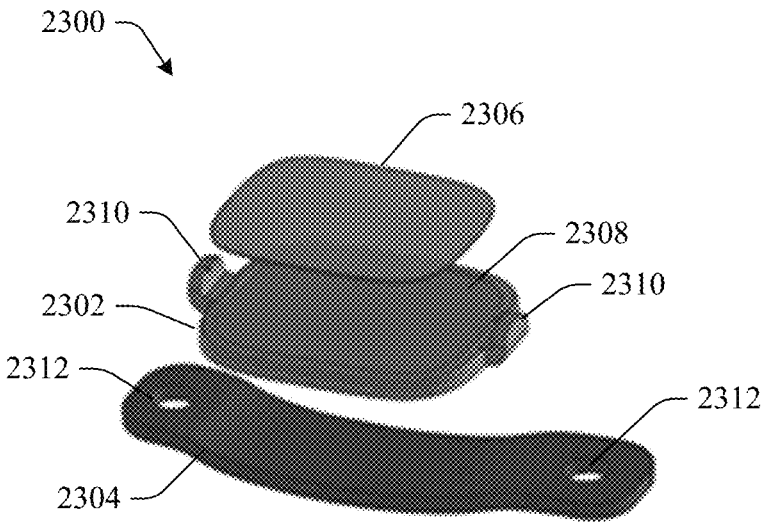
FIGS. 23A-23B are illustrations of another embodiment of a display device in accordance with an aspect of the innovation.
Figure 23B:
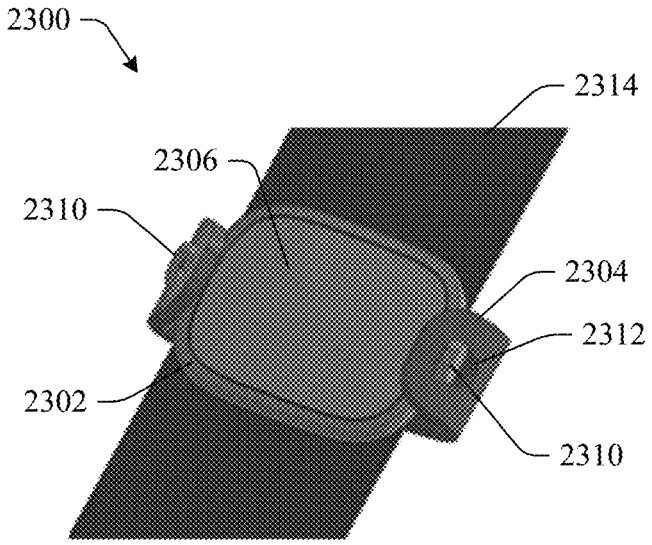

FIGS. 23A-23B illustrate another embodiment of an attachable device 2300 in accordance with an aspect of the innovation. The attachable device 2300 is similar to the attachable device 2200 illustrated in FIGS. 22A-22C in that the attachable device 2300 includes an integrated display part 2302 with a display area 2308 and ears 2310, a fastening (mounting) part 2304, and, a cover or dome 2306. Thus like features will not be repeated.

The fastening part 2304, however, is rectangular in shape and includes an aperture 2212 defined at each end. The fastening part 2304 attaches the display part 2302 to a strap 2214 or object similarly to the embodiment illustrated in FIGS. 22A-22C. In this embodiment, however, the ears 2310 engage the apertures 2212, see FIG. 23B, to thereby attach the display part 2302 to the strap 2214.

In another embodiment, the attachable device may include an optional clip. The clip may be mounted on the back of the display part or on the back of the mounting part. Thus, as an alternative, the attachable device can be clipped to a belt, strap, pocket, etc. In yet another embodiment, the attachable device may include two parts that clips around a belt, strap, etc. Thus, the attachable device can include any type of mechanical attaching means to attach the attachable device to an object mentioned above. Thus, the attaching means (e.g. strap, clip, etc.) disclosed herein are for illustrative purposes only and are not intended to limit the scope of the innovation.

The attachable device described herein has many applications that are not disclosed herein. For example, the device can be used to wrap around other objects, such as but not limited to, shoelaces, shirt sleeves, cords, necklace, belts, ropes, wrist, etc. In other words, the attachable device can be used on an unlimited number of applications. Thus, the applications disclosed herein are for illustrative purposes only and are not intended to limit the scope of the innovation.

In still yet another application, the attachable device can be made in any color or colors as desired. For example, the display part and the mounting part can be the same color or different colors to represent school colors, team color, company colors, etc. Still further, in another embodiment both the display part and/or the mounting part can display multiple colors. In other aspects, patterns (e.g., circles, squares, tie-dye, etc.) could be created on the attachable device. As well, other materials, single materials, fabric, Velcro, single piece of silicone that has a chamber to insert a puck like image, etc. can be employed to accomplish features, functions and benefits of the innovation. In other embodiments, the attachable device can contain glitter, be made from a material that glows, can include scents, can change color based on temperature, or change color based on mood. These alternatives are to be included within the scope of the specification and claims appended hereto.

In still yet another embodiment, the display area of the display part can be transparent. Thus, a picture can be disposed inside the display part so that it can be seen through the transparent display area that may or may not include magnification. Thus, the attachable device can serve a locket.

In alternate embodiment, the attachable device disclosed herein can be configured as a radio frequency identification (RFID) tag. The RFID tag can electronically store information that can be read by other devices. Thus, the attachable device can be used as an electronic identification tag or be used for tracking purposes.

In yet another alternate embodiment, the attachable device disclosed herein can be configured as a near field communication (NFC) device. The NFC device can establish communication with similar devices including RFID tags when in close proximity. Thus, the attachable device can exchange data and other information with the other similar devices.

In yet another embodiment, the attachable device may include lights to light the face and/or the device. The lights may strobe, flicker, change color, etc.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An attachable display device comprising:

a display part having a first portion including a display area to display an image, a second portion having a mounting part attachment point, and a securing portion, the first portion further including a plurality of elongated raised ridges and a latching portion located at a periphery of the first portion, the latching portion latching the first portion with the second portion when the display part is in a closed position; and a mounting part extending outward from one side of the display part and having a display attachment portion and a strap portion having at least one hole defined therein, the display attachment portion including a plurality of indentations defined therein that receive the plurality of elongated raised ridges from the first portion of the display part thereby aligning and securing the mounting part inside the display part when the display part is in the closed position, the display attachment portion being attached to the second portion of the display part at the connection point, wherein the securing portion extends outward from another side of the display part in a direction opposite to that of the mounting part, and wherein the mounting part wraps around an object such that the securing portion engages the at least one hole in the strap portion to secure the display device to the object.

2. The display device of claim 1, wherein the first and second portions snap together.

3. The display device of claim 1, wherein the mounting portion is an integrated piece configured to function as a strap made from an elastic material.

4. The display device of claim 1, wherein the display part including the securing portion and the mounting part are integrated into a single piece.

5. The display device of claim 1 further comprising a cover removably attachable to the display part.

6. The display device of claim 5, wherein the cover has a transparent face.

7. The display device of claim 5, wherein the cover has a transparent face and wherein the transparent face includes magnification.

8. The display device of claim 1, wherein the display part includes a urethane dome with digital print attached with adhesive or magnet.

9. An image display device comprising:

a display part having a display area to display an image, a first portion, a second portion having a mounting part attachment point, at least one of the first portion and the second portion including a plurality of surface treatments and a latching portion located at a periphery of the at least one of first and second portion, the latching portion latching the first portion with the second portion when the display part is in a closed position;

a removable-transparent cover to facilitate the replacement of the image;

a securing portion operatively connected to the display area; and a mounting part extending outward from one side of the display area and having a display attachment portion and a strap portion having at least one hole defined therein, the display attachment portion including a surface defined therein that receives the surface treatment from the at least one of the first portion and the second portion of the display part thereby aligning and securing the mounting part inside the display part when the display part is in the closed position, the display attachment portion being attached to the second portion of the display part at the connection point, wherein the securing portion extends outward from another side of the display area in a direction opposite to that of the mounting part, and wherein the mounting part wraps around an object such that the securing portion engages the at least one hole in the strap portion to secure the image display device to the object.

10. The image display device of claim 9 further comprising a magnet disposed in an opening defined in the display area, wherein the removable-transparent cover is magnetically attracted to the magnet thereby securing the image to the display area.

11. The image display device of claim 10, wherein the mounting part includes an alignment projection adapted to engage an aperture defined in the second portion of the display part.

12. A method of displaying an awareness item comprising:

providing a display device having a display part, a first portion, a second portion, and a mounting part that extends outward from one side of the display part, the display part having a display area to display an image and a securing portion that extends outward from another side of the display part in a direction opposite to that of the mounting part;

inserting a display attachment portion of the mounting part into the display part;

attaching the mounting part to a mounting part attachment point located in the second portion of the display part;

closing the display part;

engaging a plurality of elongated ridges extending outward from an inside surface of one of the first portion or the second portion of the display part with a plurality of indentations defined in the display attachment portion of the mounting part;

aligning and securing the display attachment portion of the mounting part inside the display part;

latching the first portion with the second portion with a latching portion located at a periphery of the first portion of the display part;

wrapping the mounting part around an object;

inserting the securing portion of the display part through a hole defined in a strap portion of the mounting part; and displaying the image.

13. The method of claim 12, wherein the first and second portions snap together.

14. The method of claim 12, wherein the mounting portion is an integrated piece configured to function as a strap made from an elastic material.

* * * * *